US006675718B1

(12) United States Patent
Parker

(10) Patent No.: US 6,675,718 B1
(45) Date of Patent: Jan. 13, 2004

(54) HYDRAULIC CYLINDER PROJECTILE AND METHOD OF MAKING THE SAME

(76) Inventor: Bobby J. Parker, 691 Bluegrass Dr., Spring Creek, NV (US) 89815-6967

( * ) Notice: Subject to any disclaimer, the term of this patent is extended or adjusted under 35 U.S.C. 154(b) by 0 days.

(21) Appl. No.: 10/273,824

(22) Filed: Oct. 17, 2002

(51) Int. Cl.[7] ..... F42B 10/00

(52) U.S. Cl. ..... 102/510; 102/507; 102/511; 102/514

(58) Field of Search ..... 102/506–518

(56) References Cited

U.S. PATENT DOCUMENTS

| | | | | | |
|---|---|---|---|---|---|
| 843,017 | A | * | 2/1907 | Hoxie | 102/510 |
| 896,021 | A | | 8/1908 | Hoxie | 102/510 |
| 911,591 | A | * | 2/1909 | Hoxie | 102/510 |
| 1,512,026 | A | | 10/1924 | Holden et al. | 102/510 |
| 1,715,788 | A | | 6/1929 | Rousseau | 102/510 |
| 3,429,263 | A | | 2/1969 | Snyder et al. | 102/513 |
| 3,866,536 | A | * | 2/1975 | Greenberg | 102/91 |
| 3,942,408 | A | | 3/1976 | Bernath | 86/19 |
| 3,972,286 | A | * | 8/1976 | Canon | 102/38 |
| 4,216,722 | A | * | 8/1980 | Angell | 102/91 |
| 4,665,827 | A | | 5/1987 | Ellis, II | 102/510 |
| 4,776,279 | A | | 10/1988 | Pejsa | 102/510 |
| 4,938,147 | A | | 7/1990 | Czetto, Jr. | 102/507 |
| 5,149,913 | A | | 9/1992 | Arakaki | 102/506 |
| 5,349,907 | A | | 9/1994 | Petrovich et al. | 102/506 |
| 6,176,186 | B1 | | 1/2001 | Engel | 102/510 |
| 6,178,890 | B1 | | 1/2001 | Burczynski | 102/507 |

FOREIGN PATENT DOCUMENTS

| | | |
|---|---|---|
| DE | 2843167 A1 | 4/1980 |
| GB | 14717 | of 1900 |

OTHER PUBLICATIONS

Sam Fadala, Bob's Hydraulic Black–Powder Bullet, Jul.–Aug. 1996, 10, 11, 71.
Nosler Bullet AD.
Application for U.S. patent No. 08/501,255; Filing Date Jul. 11, 1995; Bobby J. Parker.

* cited by examiner

*Primary Examiner*—Jack Keith
(74) *Attorney, Agent, or Firm*—Law Office of Duncan Palmatier Gary Peterson

(57) ABSTRACT

A hydraulic cylinder projectile assures radial expansion of the projectile upon impact at low velocity with a target. A hydraulic cylinder insert is disposed in an axial central bore of a projectile body. The hydraulic cylinder insert has a closed leading end, and a compression ram element is disposed in the leading end of the insert. Liquid is disposed in the cylinder aft of the compression ram element. The hydraulic cylinder insert and projectile and the method of producing the same are described and claimed.

18 Claims, 2 Drawing Sheets

HYDRAULIC CYLINDER PROJECTILE AND METHOD OF MAKING THE SAME

The present invention relates to a projectile that expands upon impact with a target, and more particularly, is concerned with a projectile containing a hydraulic cylinder and ram for enhancing radial expansion of the projectile upon its impact with a target. The present invention is further concerned with a method of making such a projectile.

BACKGROUND OF THE INVENTION

When hunting with a firearm, it is usually desirable that the projectile expand radially upon impact. Expansion of the projectile maximizes tissue damage, resulting in a more expeditious and humane kill.

Projectiles that radially expand upon impact with a target are known in the art. Many are comprised of a soft deformable material, such as lead, so they undergo some axial compression and radial expansion upon impact. Others are specifically designed to produce radial expansion. One approach taken in the prior art is to include a cavity in the leading end of the projectile, a so-called "hollow point." Another approach includes a cavity in the leading end of the projectile, with a tip or piston in the cavity which is driven into the cavity by the impact with the target, causing radial expansion.

A third approach also includes a cavity. The cavity is filled with a substance or liquid that causes radial expansion. U.S. Pat. No. 5,349,907, Petrovich et al., teaches a projectile with a fluid filled cavity and a shaft disposed in the cavity aft of the fluid. Upon impact, the shaft is driven into the fluid, and compressive pressure on the fluid causes radial expansion. U.S. Pat. No. 3,429,263, Snyder et al., teaches a projectile with a paint-filled cavity that is used for marking targets at a distance. The Snyder patent claims radial expansion of the projectile due to compressive pressure on the paint upon impact.

Rousseau, in U.S. Pat. No. 1,715,788, discloses a hollow point projectile with a cavity, that when filled with fluid by impact with soft tissue, causes radial expansion of the projectile. U.S. Pat. No. 1,512,026, Holden et al., teaches a projectile with a fluid-filled tip attached to the leading end. Upon impact with a target, the compressive pressure on the fluid in the tip is conveyed by a depression in the core of the projectile, or by a jacket that surrounds the core, and causes radial expansion of the projectile.

The present inventor sells a lead projectile with a fluid-filled cavity and a steel, ball-shaped ram at one end of the cavity nearest the projectile's tip. The projectile is made by forming the cavity in the projectile, filling the cavity with fluid, placing a ball on top of the fluid, and spin welding the projectile tip over the ball.

Prior art projectiles with fluid-filled cavities achieve radial expansion upon impact. However, the Petrovich, Snyder and Holden projectiles and the inventor's product each require special manufacture at increased cost. The Rousseau projectile achieves radial expansion only on impact with soft, fluid-rich tissue, a drawback if the projectile strikes boney or thin tissue. These inventions lack a structure and method to mass produce an insert that will create a projectile with consistent expansion properties.

Additionally, projectiles fired from muzzle-loading firearms move at lower velocity than projectiles fired from modern rifles. A projectile specifically prepared for radial expansion at low velocity is of particular interest when hunting with these firearms. The inventor tested the disclosed invention and compared its expansion characteristics to those of other designs. These tests have shown that the disclosed invention has significantly greater radial expansion properties, especially at the low velocities imposed by muzzle-loaded firearms. None of the above-described patents disclose a projectile designed to maximize radial expansion at low velocity and simplicity and low-cost manufacture.

A need exists, particularly in muzzle-loading and other low velocity applications, for a radially expanding projectile, adaptable to a wide variety of calibers and other variations, that is inexpensive to manufacture. The disclosed invention meets these needs with a new design.

SUMMARY OF THE INVENTION

It is one object of the present invention to provide a projectile that expands radially upon impact with a target. It is another object of the present invention to provide a projectile that expands radially upon impact with a target, especially when fired at low velocity. It is another object of the present invention to provide an inexpensive method of manufacture for such projectiles. It is another object of the present invention to provide a method of manufacture for a radially expanding hydraulic cylinder projectile that is adapted to a wide variety of calibers and other variations among projectiles.

In accordance with these objectives, the present invention provides a hydraulic cylinder projectile and a method of making the hydraulic cylinder projectile. According to the present invention, an hydraulic cylinder is formed. Preferably, the hydraulic cylinder is formed of a soft material, such as lead. The hydraulic cylinder can be mass produced by a conventional press or by molding. The hydraulic cylinder is closed at one end and open at the other end.

A compression ram element, preferably a solid spherical body, such as a steel ball bearing or BB, is disposed inside the closed end of the hydraulic cylinder. A quantity of substantially incompressible liquid, preferably food-grade lubricant, is then placed within the hydraulic cylinder. Food-grade lubricant is preferred because it will not contaminate the meat of the target animal. The food-grade lubricant can be pumped into the cylinder. The resulting insert structure is a hydraulic cylinder and ram. The insert is placed in a projectile body, with the closed end and compression ram elementat the leading end of the projectile.

The projectile, which is usually made of a soft deformable material, such as lead, is formed with a central, axial bore, opening at its leading end. The insert extends from the leading end of the projectile rearward through the projectile body such that the forward portion of the projectile body laterally surrounds the hydraulic cylinder. Thus, even while projectiles may be of various calibers or shapes, a common insert can be mass produced and used.

Upon impact of the leading end of the hydraulic cylinder projectile with a target, the compression ram element is slowed by the impact, relatively more than the rearward base portion of the projectile. The compression ram element is axially forced into the hydraulic cylinder, exerting a compressive pressure on the liquid. Since the liquid is substantially incompressible, the compressive pressure on the liquid causes a radial expansion of the hydraulic cylinder, and a corresponding radial expansion of the forward portion of the projectile body. This radial expansion creates a larger area of destructive impact; that is, a larger hole. A larger hole substantially increases the chances of killing or significantly wounding the target.

The particular axial length of the central bore of a given projectile body, and the length of the corresponding hydraulic cylinder, substantially determine, and may be selected to control, the degree of radial expansion of the projectile. The axial length of the central bore and the hydraulic cylinder also may be chosen so the rearward base portion of the projectile body has quantity of mass great enough to produce both the desired radial expansion of the forward portion of the projectile, and also the desired degree of penetration of the target.

In contrast to the existing art, the present invention encloses fluid in a separate cylinder and is distinct from the inventions of Petrovich and Snyder, which dispose fluid directly in a cavity in the projectile. The present invention is also distinct from the inventor's product. The present invention allows a variety of calibers and projectile shapes, and is more economical to manufacture, because the hydraulic cylinder insert is standardized. The present invention is also distinct from the Rousseau invention which relies on fluid from soft tissue upon impact.

The present invention is also distinct from Holden, which disposes air or other fluid in a tip attached to the front of a projectile. Instead of fluid in a tip, the present invention disposes a hydraulic cylinder containing incompressible liquid within the body of the projectile, and does not include a jacket surrounding the projectile.

The great advantage of the present invention over all of the existing art, is that the hydraulic cylinder insert can be mass produced at low cost, and is then suitable for inserting in a wide variety of projectile shapes and calibers. The present invention is distinct from the prior art because the hydraulic cylinder can be sold as a separate unit. For example, the hydraulic cylinder with ram element and incompressible liquid can be sealed with wax and sold in quantity to individuals who desire to make projectiles with the present design. Thus, the present invention achieves or improves upon the radial expansion of the projectiles of the existing art, and provides a distinct advance in ease and reduced cost of manufacture with the new design that encloses the liquid in a versatile hydraulic cylinder insert.

The method of making the hydraulic cylinder projectile of the present invention comprises the steps of: (a) providing a relatively soft and deformable projectile body, having a forward portion, a rearward base portion, and a central bore extending axially from a leading end substantially through the forward portion of the projectile body; (b) forming an hydraulic cylinder insert from a relatively soft and deformable material; (c) disposing a compression ram element in a leading end of the hydraulic cylinder insert; (d) disposing a quantity of incompressible fluid rearwardly of the compression ram element within the hydraulic cylinder insert; and (e) inserting the hydraulic cylinder insert within the central bore of the projectile body so the compression ram element is disposed at the leading end of the projectile body. A close fit between the hydraulic cylinder insert and the bore of the projectile body will hold the insert in place. Similarly, a close fit between the ram element and the hydraulic cylinder insert will hold the ram in place. Additionally, suction and surface tension between the ram element and the fluid in the hydraulic cylinder will hold the ram in place. If lead is used for the projectile or insert, a close friction fit is easily achieved. If additional security is desired, spin welding the leading end of the projectile body around the hydraulic cylinder and the compression ram element can form a closed seal.

The projectile body may be manufactured with a central bore by a press or by molding. Alternatively, the central bore may be formed in a projectile body by drilling or by pneumatic or hydraulic punch. Preferably the hydraulic cylinder insert is manufactured by a machine press, such as a swaging machine, from a pellet or wire. Conventional machine presses allow mass production of the inserts. Alternatively, the soft hydraulic cylinder insert may be molded. Molding can also allow mass production of the inserts. Deformation of the leading end of the projectile body to form a seal may be accomplished with a rotating nose punch, which spin welds the nose of the projectile over the insert.

DESCRIPTION

Figure 1:
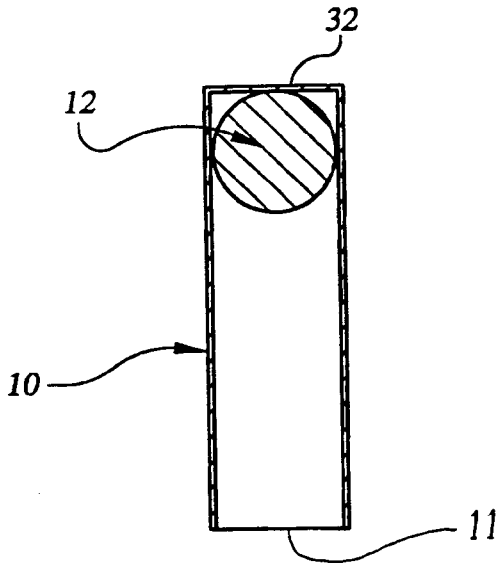
FIG. 1 is a cut-away side view of the hydraulic cylinder and a spherical compression ram element.

FIG. 1 shows a cylinder (10) having a closed end (32), an open end (11), and a compression ram element (12). The cylinder (10) is preferably made from a soft deformable metal such as lead, and may be pressed with a swaging machine from a pellet or from a spool of wire fed into the machine. The compression ram element (12) is preferably made of a material, such as steel, which is harder than the metal forming the cylinder (10). A "BB" is an example of an acceptable compression ram element (12). The outside diameter of the compression ram element (12) is substantially equal to the inside diameter of the cylinder (10), so that a friction fit between them is achieved.

Figure 2:
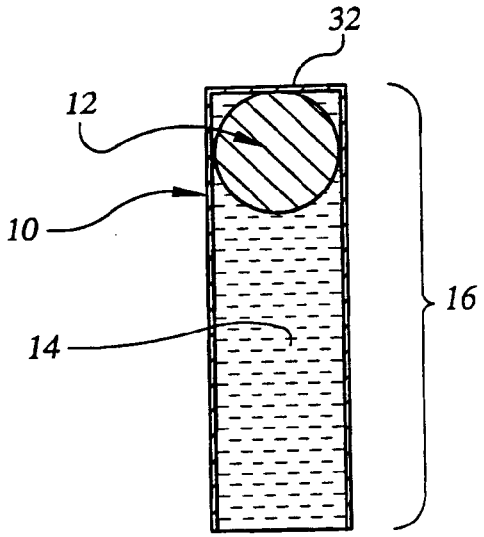
FIG. 2 is a cut-away side view of the hydraulic cylinder insert.
Figure 3:
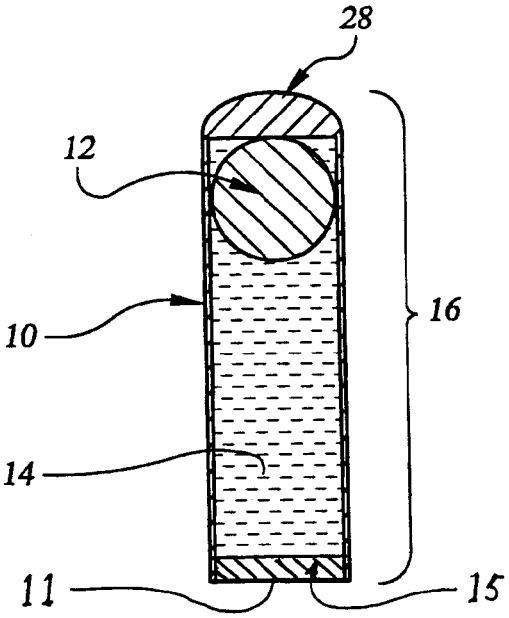
FIG. 3 is a cut-away side view of a second embodiment of the hydraulic cylinder insert.

FIG. 2 shows a cut-away side view of the cylinder (10) having a closed end (32), fitted with a spherical compression ram element (12). The ram element (12) is placed at one end of the cylinder (10). A quantity of fluid (14), such as food-grade lubricant, is injected into and fills the cylinder (10). The cylinder fitted and filled as shown and described is referred to as the hydraulic cylinder insert (16). As shown in FIG. 3, in an alternative embodiment, the hydraulic cylinder insert (16) is sealed (15) at the open end (11). The seal (15) may be wax or any other suitable material. Sealing (15) the open end (11) provides an hydraulic cylinder insert (16) that can be sold as a separate unit. Individuals can purchase the separate hydraulic cylinder insert (16) and make projectiles incorporating it.

Figure 4:
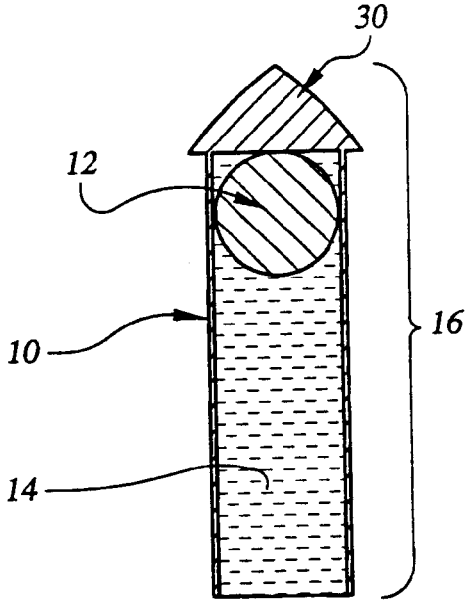
FIG. 4 is a cut-away side view of a third embodiment of the hydraulic cylinder insert.

FIGS. 3 and 4 show alternative embodiments of the present invention. FIG. 3 shows a cut-away side view of an embodiment of the hydraulic cylinder insert (16) having a rounded closed end (28). FIG. 4 shows a cut-away side view of yet another embodiment of the hydraulic cylinder insert

(16) having a pointed closed end (30). The embodiments shown in FIGS. 3 and 4 disclose an hydraulic insert (16) with leading ends that allow greater projectile velocity.

Figure 5:
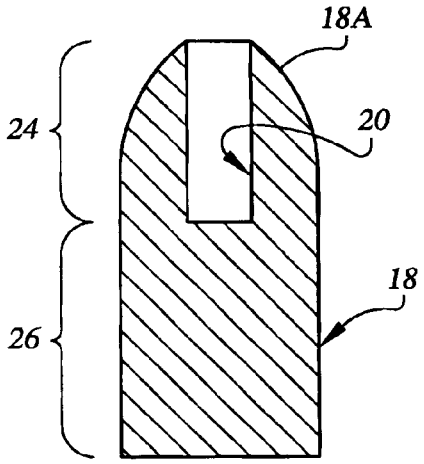
FIG. 5 is a cut-away side view of a projectile body having a central bore.

FIG. 5 shows a cut-away side view of a projectile body (18) having an axial central bore (20). The projectile body (18) can be any of several shapes or calibers, and is usually formed of a soft deformable metal, such as lead. The projectile body (18) may be manufactured with the central bore (20) formed in the forward portion (24) by a hydraulic press or by molding. Alternatively, a central bore (20) can be formed in a projectile body (18) in another manner, such as drilling or punching. The central bore (20) is located at the axial center of the leading end (18A) of the projectile body (18), and forms an opening at the leading end (18A). Rearward of the central bore (20) is the rearward base portion (26). Preferably, the central bore (20) will extend rearwardly the length of the cylinder (10), but less than half the length of the projectile body (18) so the rearward base portion (26) is of sufficient mass to avoid significant deformation on impact, and to propel the projectile body (18) into the target.

Figure 6:
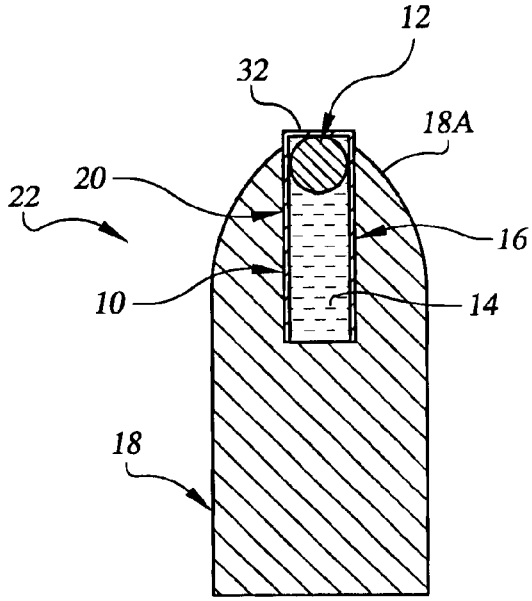
FIG. 6 is a cut-away side view of the hydraulic cylinder insert disposed in the central bore of a projectile.

FIG. 6 shows a cut-away side view of the present invention (22). The cylinder (10) is fitted with the compression ram element (12), and filled with incompressible fluid (14), (the hydraulic cylinder insert (16), as fitted and filled). The hydraulic cylinder insert (16) is disposed in the central bore (20) of the projectile body (18), with the compression ram element (12) disposed at the leading end (18A). A close fit between the hydraulic cylinder insert (16) and the central bore (20) of the projectile body (18) will hold the insert in place. If the hydraulic cylinder insert (16) and projectile body (18) are made of lead, the tolerances between the insert (16) and the central bore (20) need not be very close, which makes manufacturing easier and less expensive. Similarly, a friction fit between the ram element (12) and the cylinder (10) will hold the ram in place. Again, if the cylinder (10) is made of lead, the tolerances do not have to be very close to achieve a friction fit. It will be appreciated that suction and surface tension between the ram element (12) and the fluid (14) in the cylinder (10) will tend hold the ram (12) in place. If additional security is desired, the leading end (18A) of the projectile body (18) may be spin welded over the hydraulic cylinder insert (16) by pressing the leading end (18A) of the assembly (22) against a rotating concave nose, thereby heating and deforming the leading end (18A) over the insert (16). Alternatively, the leading end (18A) of the projectile body (18) may be sealed over the hydraulic cylinder insert (16) by pressing the leading end (18A) of the assembly (22) against an hydraulic die, thereby deforming the leading end (18A) over the insert (16).

Figure 7:
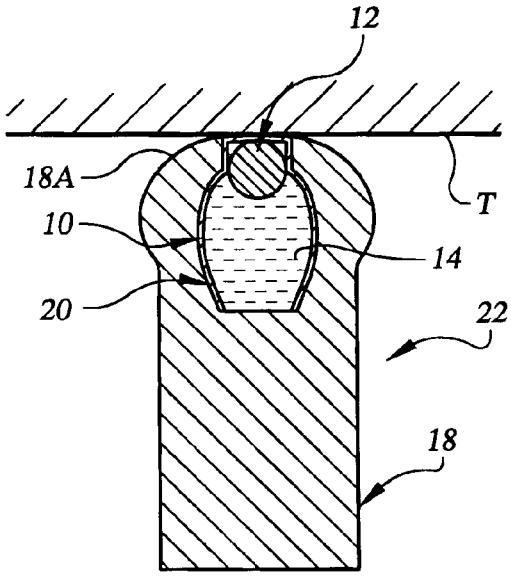
FIG. 7 is a cut-away side view of the hydraulic cylinder insert, disposed in the central bore of a projectile, immediately after impact with a target.
Figure 8:
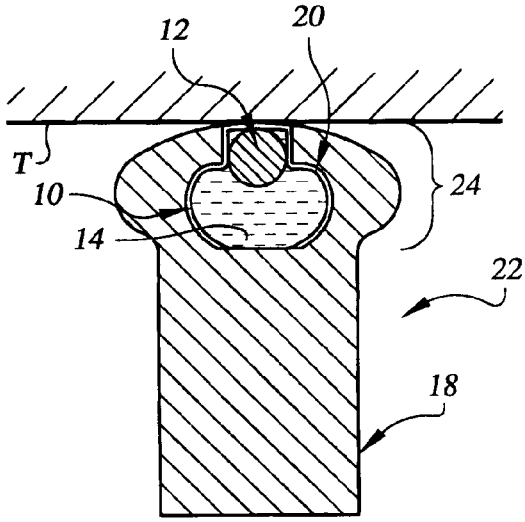
FIG. 8 is a cut-away side view of the hydraulic cylinder insert, disposed in the central bore of a projectile, after impact with a target, showing the deformation and radial expansion of a forward portion of the projectile.

Illustrated in FIG. 7 and FIG. 8 is the manner in which the hydraulic cylinder projectile assembly (22) expands radially upon impact with a target (T). FIG. 7 is a cut-away side view of the hydraulic cylinder projectile (22) immediately after impact with a target (T). When the leading end (18A) of the projectile body (18) strikes the target (T), the compression ram element (12) is driven into the cylinder (10), and places compressive pressure on the substantially incompressible fluid (14). The fluid (14) transmits this pressure radially to the sidewall of the cylinder (10) and to the sidewall of the central bore (20) of the projectile body (18). The projectile body (18) expands radially as a result of this pressure. Thus, FIG. 8 shows the hydraulic cylinder projectile (22) slightly later after impact with a target (T), showing the continued deformation and radial expansion of the forward portion (24) of the projectile (10). The force of the substantially incompressible fluid (14) substantially flattens the projectile (22), providing a greater radial area of destruction.

A significant advantage of the hydraulic cylinder projectile (22) is the assurance of radial expansion upon impact at low velocity, as in muzzle-loading firearms. Another advantage is ease of manufacture. Because the cylinder (10) and central bore (20) may be of fixed diameters, even though the projectile body (18) is a different shape or caliber, machines for fitting the compression ram element (12) and filling the cylinder (10) with incompressible fluid (14) need not be reconfigured. A hydraulic cylinder (16) will fit a variety of projectile bodies (18).

The drawings and description set forth here represent only some embodiments of the invention. After considering these, skilled persons will understand that there are many ways to make a hydraulic cylinder projectile according to the principles disclosed. The inventor contemplates that the use of alternative structures, materials, or manufacturing techniques, which result in a hydraulic cylinder insert, or a hydraulic cylinder projectile according to the principles disclosed, will be within the scope of the invention.

What I claim is:

1. A hydraulic cylinder projectile, comprising:

a cylinder made of a soft deformable metal and having one closed end, a compression ram, made of a relatively harder material than the cylinder, disposed in the closed end of the cylinder, a quantity of substantially incompressible fluid filling the cylinder, a projectile body made of a soft deformable metal, having a leading end, a forward portion and a rearward base portion, and having a central axial bore extending from the leading end substantially along the length of the front portion, wherein the cylinder, containing the compression ram and fluid, is disposed in the central bore of the projectile body so the closed end of the cylinder is at the leading end of the projectile.

2. The hydraulic cylinder projectile of claim 1 wherein the compression ram is a solid spherical body.

3. The hydraulic cylinder projectile of claim 1 wherein the compression ram is made of steel.

4. The hydraulic cylinder projectile of claim 1 wherein the substantially incompressible fluid is a food-grade lubricant.

5. The hydraulic cylinder projectile of claim 1 wherein the cylinder is made of lead.

6. The hydraulic cylinder projectile of claim 1 wherein the closed end has an outer portion and the outer portion of the closed end of the cylinder is rounded.

7. The hydraulic cylinder projectile of claim 1 wherein the closed end has an outer portion and the outer portion of the closed end of the of the cylinder is pointed.

8. A method of making a hydraulic cylinder projectile, comprising the steps of:

(a) forming a projectile body with a central axial bore opening at a leading end, (b) forming a cylinder with one closed end, (c) fitting a compression ram in the cylinder at the closed end of the cylinder, (d) filling the cylinder with a quantity of fluid, and (e) inserting the cylinder into the opening of the central bore of the projectile body with the closed end of the cylinder at the leading end of the projectile body.

9. The method of claim 8, further comprising the step of sealing the leading end of the projectile body around the cylinder.

10. The method of claim 9, wherein the sealing step is performed by spin welding.

11. A hydraulic cylinder insert, comprising:

a cylinder made of a soft deformable metal and having one closed end, a compression ram, made of a relatively harder material than the cylinder, disposed in the closed end of the cylinder, a quantity of substantially incompressible fluid filling the cylinder.

12. The hydraulic cylinder insert of claim 11 wherein the closed end of the cylinder is rounded.

13. The hydraulic cylinder insert of claim 11 wherein the closed end of the cylinder is pointed.

14. A method of making a hydraulic cylinder insert for a projectile having an axial central bore with an opening at a leading end of the projectile, comprising the steps of:

(a) forming a cylinder with one closed end, wherein the cylinder is sized to be inserted into the opening of the central bore of the projectile, (b) fitting a compression ram in the cylinder at the closed end of the cylinder, and (c) filling the cylinder with a quantity of substantially incompressible fluid.

15. The method of claim 14, further comprising the step of inserting the hydraulic cylinder insert into the opening of the central bore of the projectile.

16. The method of claim 15, further comprising the step of sealing the leading end of the projectile body around the hydraulic cylinder insert, with the closed end of the cylinder directed toward the leading end of the projectile.

17. The method of claim 16, wherein the sealing step is performed by spin welding.

18. The method of claim 16, wherein the sealing step is performed by pressing the leading end of the projectile body and the closed end of the hydraulic cylinder insert against a die.

* * * * *